US005962086A

United States Patent [19]

Offen

[11] Patent Number: 5,962,086

[45] Date of Patent: Oct. 5, 1999

[54] POMPON PET

[75] Inventor: James Offen, Fresno, Calif.

[73] Assignee: Valley Decorating Company, Fresno, Calif.

[21] Appl. No.: 09/088,433

[22] Filed: Jun. 1, 1998

[51] Int. Cl.[6] ..... D04D 7/06

[52] U.S. Cl. ..... 428/4; 428/99; 28/147; 446/26

[58] Field of Search ..... 428/4, 99; 28/147; 446/26

[56] References Cited

U.S. PATENT DOCUMENTS 3,560,313 2/1971 Herkimer .
4,369,215 1/1983 Offen et al. .
5,079,046 1/1992 Kessler .
5,234,725 8/1993 Smith .

*Primary Examiner*—Alexander Thomas
*Attorney, Agent, or Firm*—Gene Scott-Patent Law & Venture Group

[57] ABSTRACT

A bundle of strands of a plastic or textile material are arranged so as to be bundled together and attached, mechanically, to a handle consisting of a pair of spaced apart legs with a spherical knob at the end of each of the legs for facilitating the grasping of the device, a pompon. The handle is configured to accept a finger of one hand between the legs in order to hold the pompon and this construction prevents the handle from easily slipping off the finger since the spacing between the spheres is too small to allow a finger to pass through. The two spheres also provide an indicia that make the spheres appear as eyeballs. As such, the pompon may be used for shaking as by cheer leaders without the fear of being dropped, or may be placed on any surface with the handle extending upwardly, and then appears to be a small creature with a thick furry coat and a pair of eyes observing its surroundings.

9 Claims, 1 Drawing Sheet

POMPON PET

BACKGROUND OF THE INVENTION

1. Field of the Invention

This invention relates generally to pompons, and more particularly to a miniature pompon that may also be used as a novelty pet article.

2. Description of Related Art

The following art defines the present state of this field:

Smith, U.S. Pat. No. 5,234,725 describes a wrist pom utilized by individuals in cheerleading and the like, to include an elastomeric tubular sleeve having a forward annular end receiving a collar therewithin, wherein the collar has fixedly secured thereto an annular array of elongate, flexible tassel webs at rear distal ends of each web. A modification of the invention includes a squeeze bulb member mounted to the sleeve to provide for selective projection of glitter particles formed of reflective material for an enhanced visual display in use of the organization.

Kessler, U.S. Pat. No. 5,079,046 describes a pompon having flexible streamers formed of transparent plastic, preferably PET, in which the transparent flexible plastic contains a fluorescent dye such that when the plastic is cut to form the streamers, the cut edges provide a glowing effect in the presence of light.

Herklmer, U.S. Pat. No. 3,560,313 describes a pompon for use by yell leaders, pep squads, and the like having stands of crepe paper or similar material secured to a body with a protective hand around the portions of the stands on the body and a handle secured to the body for holding the pompon.

Offen, et al., U.S. Pat. No. 4,369,215 describes a pompon that includes a plastic body member that has stands attached to an end thereof, and wherein a clip is provided for holding the stands in place on the member. One end of the holder or member is open so that a coupon or the like can be conveniently inserted within the member. Suitable advertisements, logos, and the like can be imprinted on the outer surface of the finger held pompon. The finger held pompon includes a receptacle that is constructed of plastic material of resilient characteristics whereby the user's finger can be conveniently inserted within the device to provide a convenient means of manipulating the pompon.

The prior art clearly teaches the construction and use of a pompon. However, the prior art does not teach that a pompon may be used also as a doll-like novelty. The art also does not teach a pompon handle that provides for the insertion of a finger in such a manner that the finger may be easily removed yet is captured with respect to lateral movement and so provides a more secure means for holding the device. The present invention fulfills these needs and provides further related advantages as described in the following summary.

SUMMARY OF THE INVENTION

The present invention teaches certain benefits in construction and use which give rise to the objectives described below.

A bundle of strands of a plastic or textile material are arranged so as to be bundled together and attached, mechanically, to a handle consisting of a pair of spaced apart legs with a spherical knob at the end of each of the legs for facilitating the grasping of the device, a pompon. The handle is configured to accept a finger of one hand between the legs in order to hold the pompon and this construction prevents the handle from easily slipping off the finger since the spacing between the spheres is too small to allow a finger to pass through. The two spheres also provide an indicia that make the spheres appear as eyeballs. As such, the pompon may be used for shaking as by cheer leaders without the fear of being dropped, or may be placed on any surface with the handle extending upwardly, and then appears to be a small creature with a thick furry coat and a pair of eyes observing its surroundings.

A primary objective of the present invention is to provide a pompon having advantages not taught by the prior art.

Another objective is to provide a pompon that is easily held by a single finger in such a manner that the finger cannot easily slip out of a handle of the device, and whereby adjacent fingers may be closed around each side of the handle to more fully secure the grasp thereupon.

A further objective is to provide such a pompon whereby the handle is sturdy yet diminutive, so as to be inobvious when the device is used for cheer leading activities.

A further objective is to provide such a pompon whereby the handle appears to be a pair of eyes, so that the pompon may be regarded as a small pet animal when not in use for cheer leading.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawing illustrates the present invention. In such drawing.

DETAILED DESCRIPTION OF THE INVENTION

Figure 1:
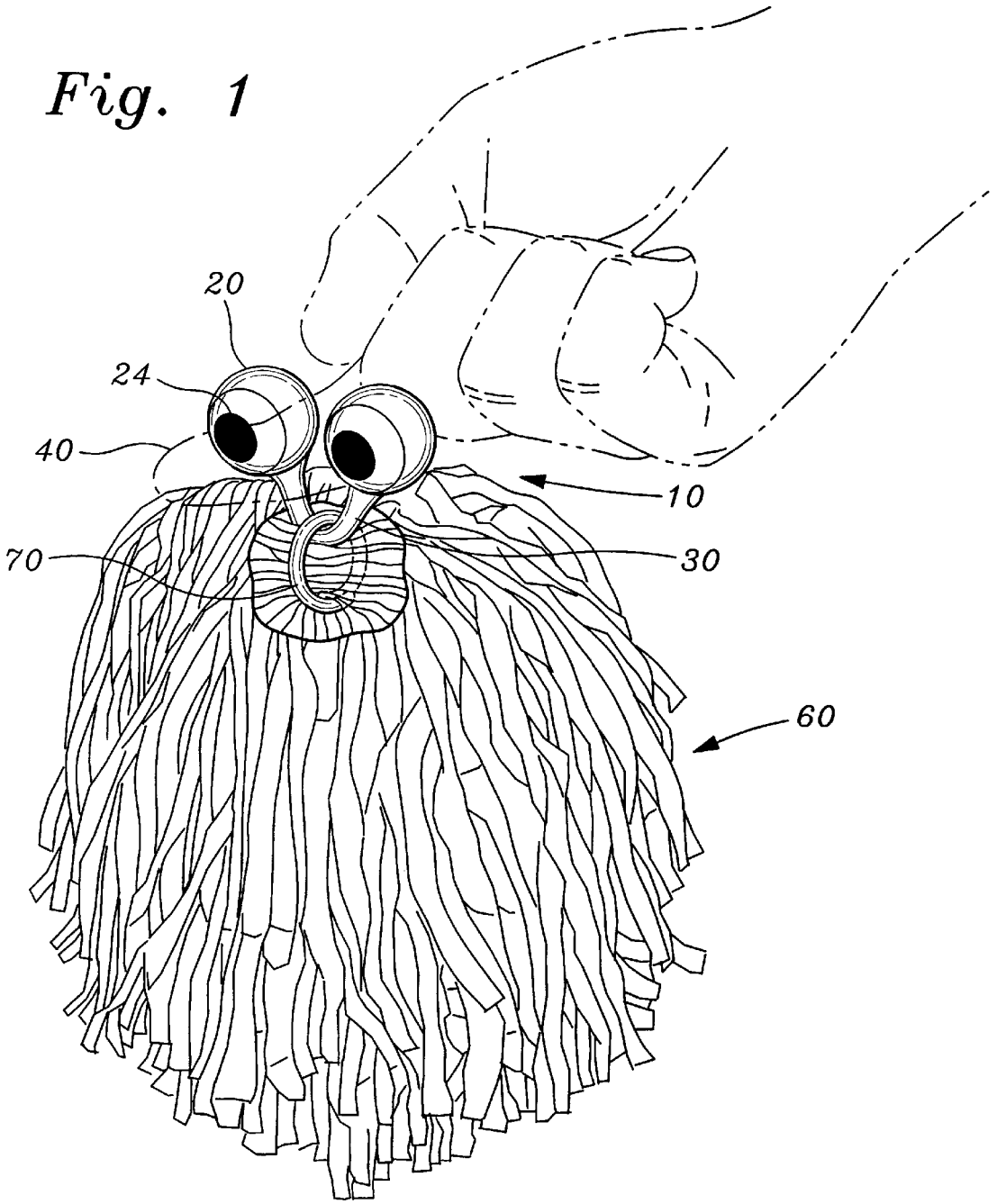
FIG. 1 is a perspective view of the preferred embodiment of the present invention shown as held by a finger of one hand in a manner in which the invention is designed to be held. A portion of the strands are cut away so as to show the interior of the strand bundle and how the strands are joined to the handle by a clip.

The above described drawing figures illustrate the invention, a pompon device comprising a U-shaped handle 10 providing a spherical knob 20 at the end of each one of a pair of legs 30 of the U-shaped handle 10, the legs 30 being spaced apart such that a finger 40 may be inserted therebetween for holding the pompon, the spherical knobs 20 being spaced apart such that the finger is not able to be withdrawn from the handle 10 by passing the finger 40 between the spherical knobs 20, a plurality of strips 50 of a flexible sheet material, the strips being arranged as a unitary bundle 60, a means for interconnection 70, the interconnection means 70 joining the bundle of strips 50 to the U-shaped handle 10 such that the bundle of strips 50 are enabled for hanging downwardly in a symmetrical manner.

Preferably the strips 50 are each between 8 and 16 inches in length and approximately 3/16 inch in width and are made of a plastic material such as low density polyethylene polymer of between 0.0002 and 0.0005 inches in thickness. It has been discovered and is considered a novelty in the art of this invention that such a material, width and thickness, provides for a very unique action when the pompon is moved, the individual strips 50 seeming to have a life of their own, moving in concert and yet in a lively manner individually.

Preferably, further, the spherical knobs 20 are spaced apart by approximately ¼ inch, the spherical knobs 20 are approximately 15/16 inches in diameter, and the legs 30 are spaced apart by approximately 9/16 inches. These dimension are not arbitrary, but form the basis for enablement of the handle to be held securely by a single finger 40 without being shaken loose. Such an enablement is considered by your applicant to comprise an inventive step in that spacing of the legs 30 and spheres 20 which is materially different from the claimed numbers results in a handle which will either not fit onto an adult hand, or will slip off easily, and is uncomfortable when the hand is placed around the handle. The combination of leg 30 spacing, sphere 20 spacing and size of sphere is a combination that is considered to include the necessary step of invention since the three variables are interactive and therefore represent an almost infinite number of possible combinations. It has been found that the present inventive combination of dimensions provides very superior results for the widest range of adult and young adult hands.

Preferably, the interconnection means 70 is preferably a wire clip but any other form of interconnection may be used. As shown in the figure, the clip 70 is preferably of the key chain type and is preferably tightened so as to tightly hold the strips 50 against the underside of the U-shaped handle 10. The figure provides a cutaway of those portions of the strips 50 that tend to block the viewers ability to see how the strips 50 extend through and relate to the wire clip 70. The strips 50 form individual strands which move independently from each other and also as a group when the device is shaken as for cheer leading activities.

Preferably, each one of the pair of spherical knobs 20 provides an exterior surface, the surface further providing an indicia 24 having the appearance of an eye, the overall appearance of each one of the spherical knobs 20 and the indicia 24 thereon being that of an eyeball, the overall appearance of the pompon, thereby being that of a small compact animal having a pair of eyeballs extending upwardly therefrom. Alternately, the handle 10 may provide any one or more elements characteristic of facial features such that the device may be conceived to be a small animal when the device is oriented with the handle 10 extending upwardly. Such facial feature elements may include other easily recognized facial features such as a mouth, a nose, hair, and so on (not shown).

In use, the finger 40 of one hand is slipped between the legs 30 of the handle 10 of the device as shown in the figure. Adjacent fingers are conveniently placed to each side of the handle 30 so that the legs 30 are sandwiched between three adjacent fingers. When this is accomplished, it is not possible for the pompon to be dropped while in use without a conscious effort to do so. The device may be shaken and used for typical cheer leading activities. When not in use the device may be placed down onto any surface with the handle 10 extending upwardly. When placed in this attitude the pompon resembles a small animal with a pair of eyes extending up. Such a device is useful as a doll novelty.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A pompon device comprising:

a U-shaped handle providing a spherical knob at the end of each one of a pair of legs of the U-shaped handle, the legs being spaced apart such that a finger may be inserted therebetween for holding the pompon, the spherical knobs being spaced apart such that the finger may not be withdrawn from the handle by passing between the spherical knobs;

a plurality of strips of a flexible sheet material, the strips being arranged as a unitary bundle;

a means for interconnection, the interconnection means joining the bundle of strips to the U-shaped handle such that the bundle of strips are enabled for hanging downwardly in a symmetrical manner.

2. The device of claim 1 wherein the strips are each between 8 and 24 inches in length and approximately 3/16 inch in width.

3. The device of claim 1 wherein the strips are made of a plastic material of between 0.0002 and 0.0005 inches in thickness.

4. The device of claim 3 wherein the strips are made of low density polyethylene polymer.

5. The device of claim 1 wherein the spherical knobs are spaced apart by approximately ¼ inch and the spherical knobs are approximately 15/16 inches in diameter.

6. The device of claim 1 wherein the legs are spaced apart by approximately 9/16 inches.

7. The device of claim 1 wherein the interconnection means is a wire clip.

8. The device of claim 1 wherein each one of the pair of spherical knobs provides an exterior surface, the surface further providing an indicia having the appearance of an eye, the overall appearance of each one of the spherical knobs and the indicia thereon being that of an eyeball, the overall appearance of the pompon, thereby being that of a small compact animal having a pair of eyeballs extending upwardly therefrom.

9. A pompon device comprising:

a U-shaped handle providing a spherical knob at the end of each one of a pair of legs of the U-shaped handle, the legs being spaced apart such that a finger may be inserted therebetween for holding the pompon, the spherical knobs being spaced apart such that the finger may not be withdrawn from the handle by passing between the spherical knobs;

a plurality of strips of a flexible sheet material, the strips being arranged as a unitary bundle;

a means for interconnection, the interconnection means joining the bundle of strips to the U-shaped handle such that the bundle of strips are enabled for hanging downwardly in a symmetrical manner;

the handle providing at least one element characteristic of a facial feature such that the device may be conceived to be a small animal when the device is oriented with the handle extending upwardly.

* * * * *